US006202300B1

(12) United States Patent
Yuzwalk

(10) Patent No.: US 6,202,300 B1
(45) Date of Patent: Mar. 20, 2001

(54) METHOD FOR ELECTRICAL GROUNDING OF VEHICULAR COMPONENTS

(75) Inventor: James J. Yuzwalk, Oxford, MI (US)

(73) Assignee: Chrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/092,373

(22) Filed: Jun. 5, 1998

(51) Int. Cl.[7] ..... H01R 43/04

(52) U.S. Cl. ..... 29/863; 29/857; 439/799; 439/813

(58) Field of Search ..... 29/828, 863, 825; 439/813, 799

(56) References Cited

U.S. PATENT DOCUMENTS 3,435,126 * 3/1969 Hamilton .
4,626,051 * 12/1986 Franks, Jr. .
4,780,096 10/1988 Franks, Jr. ..... 439/813
4,873,763 * 10/1989 Volonta et al. ..... 29/825

FOREIGN PATENT DOCUMENTS

2271688 * 12/1975 (FR) ..... 29/828

* cited by examiner

*Primary Examiner*—Carl J. Arbes
(74) *Attorney, Agent, or Firm*—Kenneth H. Maclean

(57) ABSTRACT

A method and apparatus for electrical grounding of metallic vehicular components incorporates a conductive clamping mechanism. The conductive clamping mechanism includes a first portion having an housing defining an opening. The housing rotatably carries an externally threaded member. A conductive band has a first end fixedly attached to the clamping mechanism and a second end adjustably associated with the threaded member. Rotation of the threaded member adjusts the second end of the band relative to the first end to thereby tighten the band around the metallic vehicular component. A grounding strap having a width substantially greater than a height interconnects a ground surface of the vehicle with a second portion of the clamping mechanism. The second portion is preferably unitarily formed with the housing and is adapted to crimp the end of the strap. In the preferred embodiment, the clamping mechanism is further unitarily formed to include a plurality of barbs for piercing a coating which may be applied to the exterior surface of the metallic component.

11 Claims, 1 Drawing Sheet

METHOD FOR ELECTRICAL GROUNDING OF VEHICULAR COMPONENTS

BACKGROUND OF THE INVENTION

1. Technical Field

The present invention relates in general to electrical grounding clamps. In particular, the present invention relates to a method and apparatus for electrical grounding of vehicular components. More specifically, but without restriction to the particular embodiment and/or use which is shown and described for purposes of illustration, the present invention relates to a method and apparatus for electrical grounding of vehicular components for reduction of frequencies which may adversely effect radio operation.

2. Discussion

Grounding clamps are utilized to provide an electrical ground for pipes and conduits, for example, to dissipate static electricity. In effecting such grounding, generally a solid copper wire is appropriately terminated to ground and then connected to the pipe or conduit by a clamp to effect grounding. The coupling of the terminated ground wire to the pipe or conduit to be grounded must be done in a manner to ensure an effective electrical connection between the pipe or conduit and the terminated ground wire. This coupling or connection must be maintained free from corrosion and mechanical failure, both at the connection with the terminated ground wire, and at the connection to the pipe or conduit.

To ensure suitable grounding for a pipe or conduit that is covered with paint, rust, or other material over a base metal, it is known to clean the pipe or conduit surface, for example by sanding. While such a practice is typically effective in ensuring a properly conditioned surface for grounding, it is labor intensive. To a more limited extent, it is also known to provide a grounding clamp having a strap with a plurality of abrading points for engaging an object to be grounded and cutting or scraping through an outer surface thereof as the clamping strap is tightened to ensure electrical contact. One example of such a clamping strap is shown and described in U.S. Pat. No. 4,780,096 to Franks, Jr. The grounding clamp disclosed by U.S. Pat. No. 4,780,096 includes one or more terminated ground wires identified at reference numeral 40 for grounding a pipe.

While known devices for electrically grounding, including but not limited to the arrangement shown in U.S. Pat. No. 4,780,096 have proven to be acceptable for certain applications, they are all associated with disadvantages. In this regard, known devices typically include multiple components which is undesirable for many applications, for example, automotive assembly applications. Additionally, known devices are not effective for grounding higher frequencies (e.g., greater than 15 Mhz) which typically interfere with FM band radio.

In the field of motor vehicles, it is recognized that isolated metallic vehicular components may become parasitic resonators if not sufficiently grounded. For example, a vehicle tail pipe may pick up energy from the engine compartment and resonate. Transmitted frequencies may ultimately couple with the vehicle antenna and adversely effect radio operation.

In certain known applications, wires are used to electrically interconnect such isolated metallic vehicular components with body sheet metal or the vehicle frame. While often time consuming and expensive due to the multiple part assemblies conventionally employed, this known technique is effective for lower frequencies which may effect AM radio operation. However, higher frequencies which effect FM radio operation remain problemsome.

SUMMARY OF THE INVENTION

It is a general object of the present invention to provide an improved method and apparatus for grounding metallic vehicular components to eliminate radio interference.

It is a related object of the present invention to provide a method and apparatus incorporating a one-piece assembly for grounding metallic vehicular components.

It is another related object of the present invention to provide a method and apparatus incorporating a grounding strap for effectively transmitting frequencies which may otherwise be disruptive to radio operation, particularly FM band radio operation.

In one form, the present invention provides a method for electrically grounding a metallic component of a motor vehicle to a ground surface. The method includes the general steps of providing a band having a first end and a second end, and providing a clamping mechanism. The first end of the band is fixedly attached to the clamping mechanism and the second end of the band is adjustably attached to the clamping mechanism. The clamping mechanism is operated to tighten the band about the metallic component. The method additionally includes the step of electrically interconnecting the clamping mechanism and the ground surface.

In a more preferred form, the present invention provides a method for radio frequency bonding a metallic component of a motor vehicle to a ground surface. The method includes the general steps of providing a conductive metallic band having a first end and a second end, and providing a conductive clamping mechanism including a first portion and a second portion. The first portion includes a threaded member for adjusting the first end of the grounding strap relative to the second end of the grounding strap. The second portion is adapted for engaging the first end of the grounding strap.

The method of the present invention further includes the steps of fixedly attaching the first end of the band to the first portion of the clamping mechanism and adjustably engaging the threaded member with the second end of the band. The threaded member is rotated so as to adjust the second end of the band relative to the first end of the band and thereby tighten the band about the metallic component of the motor vehicle. The second portion of the clamping mechanism is crimped to the first end of the grounding strap and the second end of the grounding strap is attached to the ground surface.

In another form, the present invention provides an aperture for electrical grounding a metal component of a motor vehicle. The motor vehicle has a ground surface. The apparatus includes a conductive clamping mechanism having a first portion having a housing which rotatably supports a threaded member. The housing defines an opening passing therethrough. The apparatus additionally includes a conductive metal band having a first end and a second end. The first end is fixedly attached to the metal housing. The second end passes through the opening and is operatively associated with the threaded member such that rotation of the threaded member in a first direction tightens the conductive metal band around the metal component of the motor vehicle. The apparatus further includes a grounding strap having a first end attached to the clamping mechanism and a second end interconnected to the ground surface of the motor vehicle.

BRIEF DESCRIPTION OF THE DRAWINGS

Other features and advantages of the invention will be evident from the following detailed description of the preferred embodiment of the invention and the accompany drawings wherein.

DETAILED DESCRIPTION OF THE PREFERRED EMBODIMENT

Figure 1:
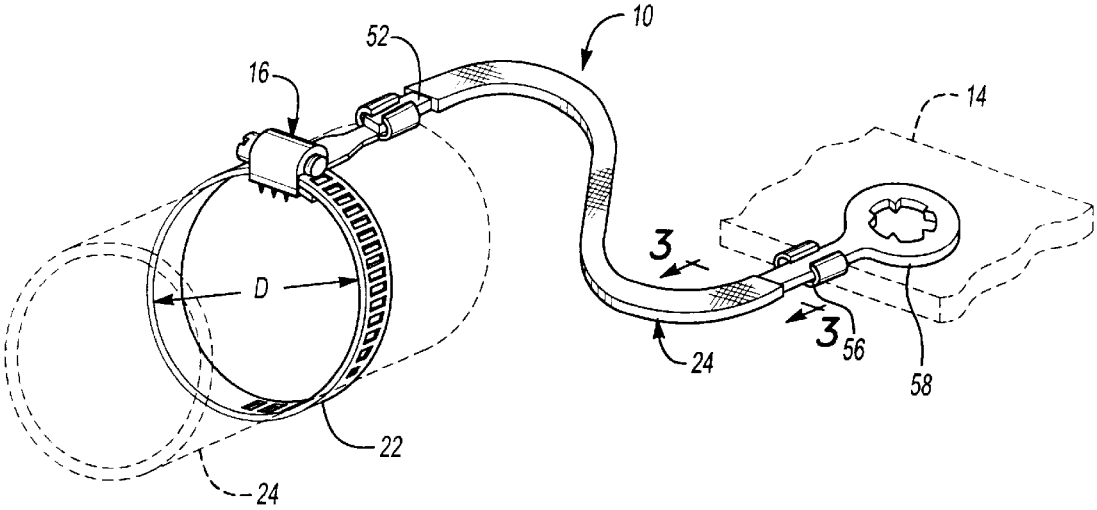
FIG. 1 is a perspective view of an apparatus for electrical grounding of a vehicular component constructed in accordance with the teachings of a preferred embodiment of the present invention.
Figure 2:
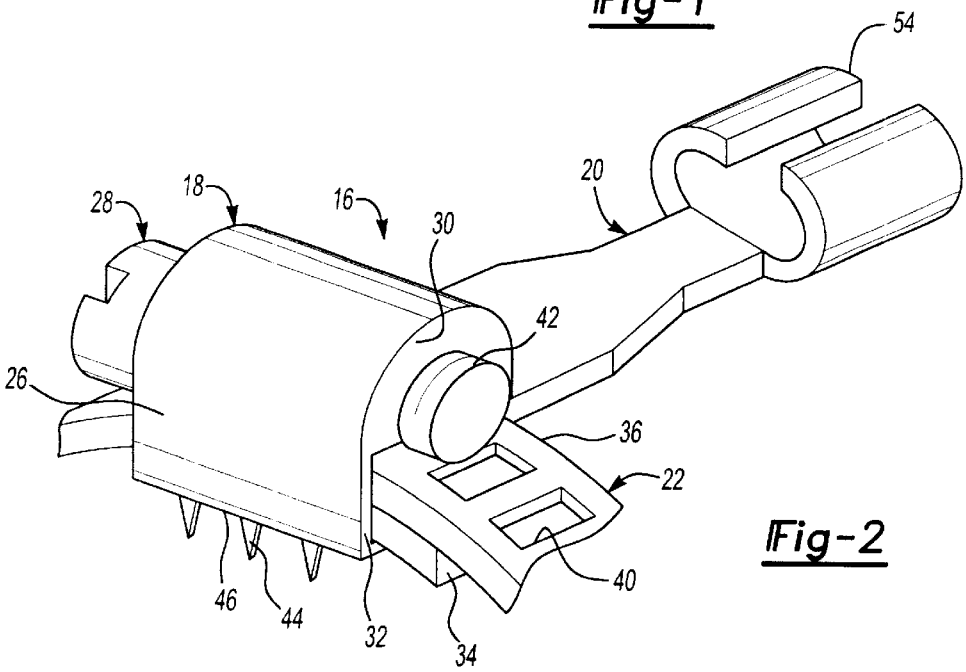
FIG. 2 is an enlarged perspective view of a portion of the apparatus of FIG. 1.

Referring now to FIGS. 1 and 2 of the drawings, an apparatus for electrical grounding of a component of a motor vehicle constructed in accordance with the teachings of the preferred embodiment of the present invention is generally identified with reference numeral 10. In the environmental view of FIG. 1, the apparatus 10 of the present invention is shown interconnecting a metallic vehicular component 12 (shown in phantom) with a ground surface 14 (also shown in phantom). It will be appreciated by those skilled in the art after reading the remainder of this detailed description that the apparatus 10 of the present invention is particularly suited for automotive applications. For example, the metallic component 12 shown in FIG. 1 may virtually be any isolated metallic component. In this regard, while the metallic component 12 is illustrated as cylindrical, it may alternatively be cylindrical, rectangular, or of any other configuration. The ground surface 14 may be any suitably grounded metal surface on the vehicle, including but not limited to sheet metal and the vehicle frame.

The apparatus 10 of the present invention is shown to generally include a clamping mechanism 16 having a first portion 18 and a second portion 20. The apparatus is additionally shown to generally include a metallic band 22 and a clamping strap 24. The first portion 18 of the clamping mechanism 16 includes a housing 26. The housing 28 rotatably supports an externally threaded member 28 within an aperture 30. The housing 28 defines a generally rectangular opening 32 for receiving first and second ends 34 and 36 of the metallic band.

The first end 34 of the metallic band 22 is fixedly attached to the housing 26. For example, the first end 34 may be welded or otherwise suitably attached to the housing 26. The second end 36 of the metallic band 22 enters the opening 32 in the housing 26 from an opposite side. The metallic band 22 is formed to include a plurality of openings 40 operatively associated with a plurality of external threads 42 of the threaded member 28. Upon rotation of the threaded member 28 in a first direction, the second end 36 of the metallic strap 22 is adjusted relative to the first end 34 of the metallic strap 22, thereby decreasing the internal diameter D of the metallic strap 22.

In the preferred embodiment, the clamping mechanism 16 is shown to include means for piercing an exterior surface (not shown) of the metallic component 12. In this regard, the metallic component 12 may be coated with a corrosion resistant material which is not conductive. In such an application, the means for piercing operates to establish electrical contact between the clamping mechanism 18 and the metallic component 12 despite the external coating. In the preferred embodiment, the means for piercing comprises a plurality of metal barbs 44 extending from an undersurface 46 of the housing 26. Further in the preferred embodiment, the plurality of metal barbs 44 are unitarily formed with the metallic housing 26.

Figure 3:
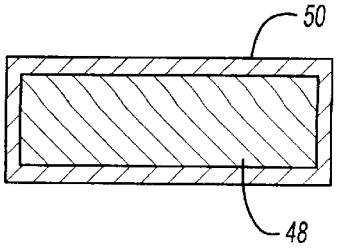
FIG. 3 is a cross-sectional view taken along the line 3—3 of FIG. 1.

With continued reference to FIG. 1 and additional reference to FIG. 3, the grounding strap 24 of the apparatus 10 of the present invention is shown to include a flexible metal member 48 and an insulating cover 50. The metal member 48 of the grounding strap 24 has a width substantially greater than its height. The resulting large surface area minimizes inductance and provides a low impedance path at high frequency.

The grounding strap 24 includes a first end 52 attached to the second portion 20 of the clamping mechanism 18. The second portion 20 is formed to include an end 54 adapted to be crimped to the first end 52 of the grounding strap 24. In the exemplary embodiment illustrated, the second portion 20 of the clamping mechanism 16 is unitarily formed of metal along with the housing 26 and barbs 44. A second end 56 of the grounding strap 24 is similarly crimped by a conventional connector 58. The connector 58 is in turn welded, bolted or otherwise suitably fastened to the grounding surface 14.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments following within the description of the appended claims.

I claim:

1. A method for electrical grounding a metallic component of a motor vehicle to a ground surface to dissipate RF frequencies, the method comprising the steps of:

(a) providing a band having a first end and a second end;

(b) providing a clamping mechanism;

(c) fixedly attaching said first end of said band to said clamping mechanism;

(d) adjustably attaching said second end of said band to said clamping mechanism;

(e) operating said clamping mechanism to tightening said band about the metallic component;

(f) electrically interconnecting said clamping mechanism and the ground surface; and (g) transmitting RF frequencies from the metallic component to the ground surface.

2. The method for electrical grounding a metallic component of a motor vehicle of claim 1, further including the step of piercing an exterior surface of the metallic component with the clamping mechanism.

3. The method for electrical grounding a metallic component of a motor vehicle of claim 1, wherein the step of electrically interconnecting said clamping mechanism and the ground surface including the steps of:

providing a generally planar ground strap having a first end and a second end, the ground strap having a generally rectangular cross-section;

interconnecting said first end of said ground strap to said clamping mechanism; and interconnecting a second end of said grounding strap to the ground surface.

4. The method for electrical grounding a metallic component of a motor vehicle of claim 3, wherein the step of interconnecting said second end of said grounding strap to said clamping mechanism includes the step of crimping a portion of said clamping mechanism to said first end of said grounding strap.

5. The method for electrical grounding a metallic component of a motor vehicle of claim 1, further comprising the step of rotating a threaded member of said clamping mechanism to adjust said first end of said band relative to said second end of said band.

6. The method for electrical grounding a metallic component of a motor vehicle of claim 1, wherein the step of transmitting RF frequencies includes the step of transmitting frequencies greater than 15 Mhz.

7. The method for electrical grounding a metallic component of a motor vehicle of claim 3, wherein said grounding strap has a width and a height, said width being substantially greater than said height.

8. A method for radio frequency bonding a metallic component of a motor vehicle to a ground surface, the method comprising the steps of:

(a) providing a generally planar grounding strap having a first end, a second end, and a generally rectangular cross-section;

(b) providing a conductive metallic band having a first end and a second end;

(c) providing a conductive clamping mechanism including a first portion with a threaded member for adjusting said first end of said grounding strap relative to said second end of said grounding strap and a second portion for engaging said first end of said grounding strap;

(d) fixedly attaching said first end of said band to said first portion of said clamping mechanism;

(e) adjustably engaging said threaded member with said second end of said band;

(f) rotating said threaded member so as to adjust said second end of said band relative to said first end of said band and thereby tightening said band about the metallic component of the motor vehicle;

(g) attaching said second portion of said clamping mechanism to said first end of said grounding strap;

(h) attaching said second end of said ground strap to the ground surface; and (i) transmitting RF frequencies from the metallic component to the ground surface.

9. The method for radio frequency grounding a component of a motor vehicle of claim 8, further including the step of piercing an exterior surface of the metallic component with the clamping mechanism.

10. The method for radio frequency bonding a component of a motor vehicle of claim 8, wherein the step of transmitting RF frequencies comprises the step of transmitting frequencies greater than 15 Mhz.

11. The method for radio frequency bonding a component of a motor vehicle of claim 8, wherein said grounding strap has a width and a height, said width being substantially greater than said height.

* * * * *